US007172268B2

(12) United States Patent
Oikawa

(10) Patent No.: US 7,172,268 B2
(45) Date of Patent: Feb. 6, 2007

(54) INK JET HEAD, METHOD FOR DRIVING THE SAME, AND INK JET RECORDING APPARATUS

(75) Inventor: Masaki Oikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 272 days.

(21) Appl. No.: 11/012,288

(22) Filed: Dec. 16, 2004

(65) Prior Publication Data

US 2005/0140734 A1 Jun. 30, 2005

(30) Foreign Application Priority Data

Dec. 26, 2003 (JP) ..... 2003-434519

(51) Int. Cl.
*B41J 2/05* (2006.01)

(52) U.S. Cl. ..... 347/56; 347/64

(58) Field of Classification Search ..... 347/20, 347/56–59, 61–65, 67
See application file for complete search history.

(56) References Cited

U.S. PATENT DOCUMENTS 4,723,129 A * 2/1988 Endo et al. ..... 347/56
5,293,182 A 3/1994 Sekiya et al. ..... 347/62
6,224,191 B1 5/2001 Saito et al. ..... 347/64
6,406,112 B1 6/2002 Oikawa ..... 347/9
6,435,660 B1 8/2002 Ozaki et al. ..... 347/63
2003/0081076 A1 5/2003 Park et al. ..... 347/65

FOREIGN PATENT DOCUMENTS

EP 0 576 017 A 12/1993
JP 2001-171127 6/2001
JP 2002-11886 1/2002

OTHER PUBLICATIONS

Patent Abstracts of Japan, vol. 2003, No. 09, Sep. 3, 2003 (JP 2003-127379, May 8, 2003).

* cited by examiner

*Primary Examiner*—Juanita D. Stephens
(74) *Attorney, Agent, or Firm*—Fitzpatrick, Cella, Harper & Scinto

(57) ABSTRACT

An ink jet head base body in which a heat accumulation layer, a heater generating heat energy used for discharging ink, and a protection film protecting the heater are sequentially formed on a substrate. The ink jet head base body is characterized in that a total thickness of a portion above from the heater in the protection film ranges from 0.2 μm to 0.6 μm, a heat resistance value of the portion above from the heater in the protection film ranges from $5\times10^{-9}$ $m^2\cdot K/W$ to $50\times10^{-9}$ $m^2\cdot K/W$, and the heat resistance value of a portion below from the heater in the heat accumulation layer is not lower than double the heat resistance value of the portion above from the heater in the protection film.

17 Claims, 12 Drawing Sheets

INK JET HEAD, METHOD FOR DRIVING THE SAME, AND INK JET RECORDING APPARATUS

BACKGROUND OF THE INVENTION

1. Field of the Invention

The present invention relates to a method for driving an ink jet head and an ink jet recording apparatus, which discharge ink according to an ink jet method to perform recording onto a recording medium, particularly relates to the method for driving an ink jet head and the ink jet recording apparatus, which utilize heat energy in order to discharge the ink.

In the invention, the term of "recording" shall mean not only to provide an image, such as characters and drawings, having a meaning to a recording medium, but also to provide the image, such as patterns, having no meaning to the recording medium.

2. Related Background Art

Recently, various kinds of recording apparatuses are used for a printer, a copying machine, a facsimile with a communication system, apparatus such as a word processor with a printer unit, and a recording apparatus combined with various processing apparatus. These recording apparatuses perform the recording to a recording medium such as paper, a string, fiber, cloth, metal, plastic, glass, wood, and ceramic. High-speed recording, high resolution, high image quality, low noise, and the like are demanded for the recording apparatuses. An ink jet recording apparatus can be cited as an example of the recording apparatus responding to such demands. In the ink jet recording apparatus, an ink jet head having a discharge port is used to eject an ink (recording solution) droplet, and the ink droplet adheres to the recording medium to perform the recording. Because the ink jet head is not in contact with the recording medium in the ink jet recording apparatus, extremely stable recording image can be obtained.

Among the conventional ink jet heads, the ink jet head which utilizes heat energy to discharge the ink can array many discharge ports in high density. Therefore, the ink jet head which utilizes heat energy to discharge the ink has advantages that high-resolution recording can be performed and the downsizing can easily be achieved.

In the conventional ink jet head which utilizes the heat energy, generally the high density is achieved by arraying a plurality of heat generating members in line on a base body such as silicon, and a common heat accumulation layer and a common electrical insulation film are formed for the plurality of heat generating members (see Japanese Patent Application Laid-Open No. 2001-171127 and Japanese Patent Application Laid-Open No. 2002-11886).

FIG. 15 is a schematic sectional view showing a heat generating member (heater) of the conventional ink jet head which utilizes the heat energy.

As shown in FIG. 15, an ink jet head 100 has a base body 120 in which a heat generating member 123 is formed and a nozzle material 110 which is connected onto the base body 120. The base body 120 has a heat accumulation layer 122 in which a plurality of layers such as a thermal oxide film are formed on a surface of a silicon substrate, the heat generating member 123 which is partially formed on the heat accumulation layer 122, electrode wirings 124 and 125 which supplied electric power to the heat generating member 123, an electrical insulation film 126 which is formed so that the heat generating member 123 and the heat accumulation layer 122 are covered with the electrical insulation film 126, and a cavitation-resistant film 127 which is formed on the electrical insulation film 126 and made of Ta. Both the electrical insulation film 126 and the cavitation-resistant film 127 constitute a protection film 128. The nozzle material 110 is bonded to the base body 120 to form a liquid path including an ink chamber 112 located above the heat generating member 123. In the nozzle material 110, a discharge port 111 is formed at an opposite position to the heat generating member 123.

The ink chamber 112 is filled with the ink, and the heat generating member 123 is heated by applying voltage to the heat generating member 123 through the electrode wirings 124 and 125. The ink in the ink chamber 112 is abruptly heated to generate film boiling by heat generation of the heat generating member 123. Therefore, a bubble is generated in the ink, and the ink is discharged from the discharge port 111 by pressure based on growth of the bubble.

In order to efficiently transfer the heat energy generated by the heat generating member 123 to the ink, various ideas for a film structure of the base body 120 have been proposed.

Referring to FIG. 16, a principle of heat transfer by the heat generation of the heat generating member 123 will be described. In FIG. 16, heat quantity Q is applied to the heat generating member 123 by energizing the heat generating member 123. The heat quantity Q is vertically dispersed to become heat quantities Q1 and Q2. The heat quantity Q1 dispersed upward is transferred to ink 130 on the protection film 128 formed by the electrical insulation film and the cavitation-resistant film. This allows a bubble 131 to be generated in the ink 130 to perform the discharge as described above.

SUMMARY OF THE INVENTION

An object of the invention is to optimize heat transfer efficiency to the ink while insulation reliability of the protection film is not decreased and cavitation-resistant characteristics are not decreased.

The invention is an ink jet head base body in which a heat accumulation layer, a heat generating member generating heat energy used for discharging ink, and a protection film protecting the heat generating member are sequentially formed on a substrate, the ink jet head base body is characterized in that a total thickness of a portion above from the heat generating member in the protection film ranges from 0.2 μm to 0.6 μm, a heat resistance value of the portion above from the heat generating member in the protection film ranges from $5\times10^{-9}$ $m^2\cdot K/W$ to $50\times10^{-9}$ $m^2\cdot K/W$, and the heat resistance value of a portion below from the heat generating member in the heat accumulation layer is not lower than double the heat resistance value of the portion above from the heat generating member in the protection film.

DETAILED DESCRIPTION OF THE PREFERRED EMBODIMENTS

Figure 1:
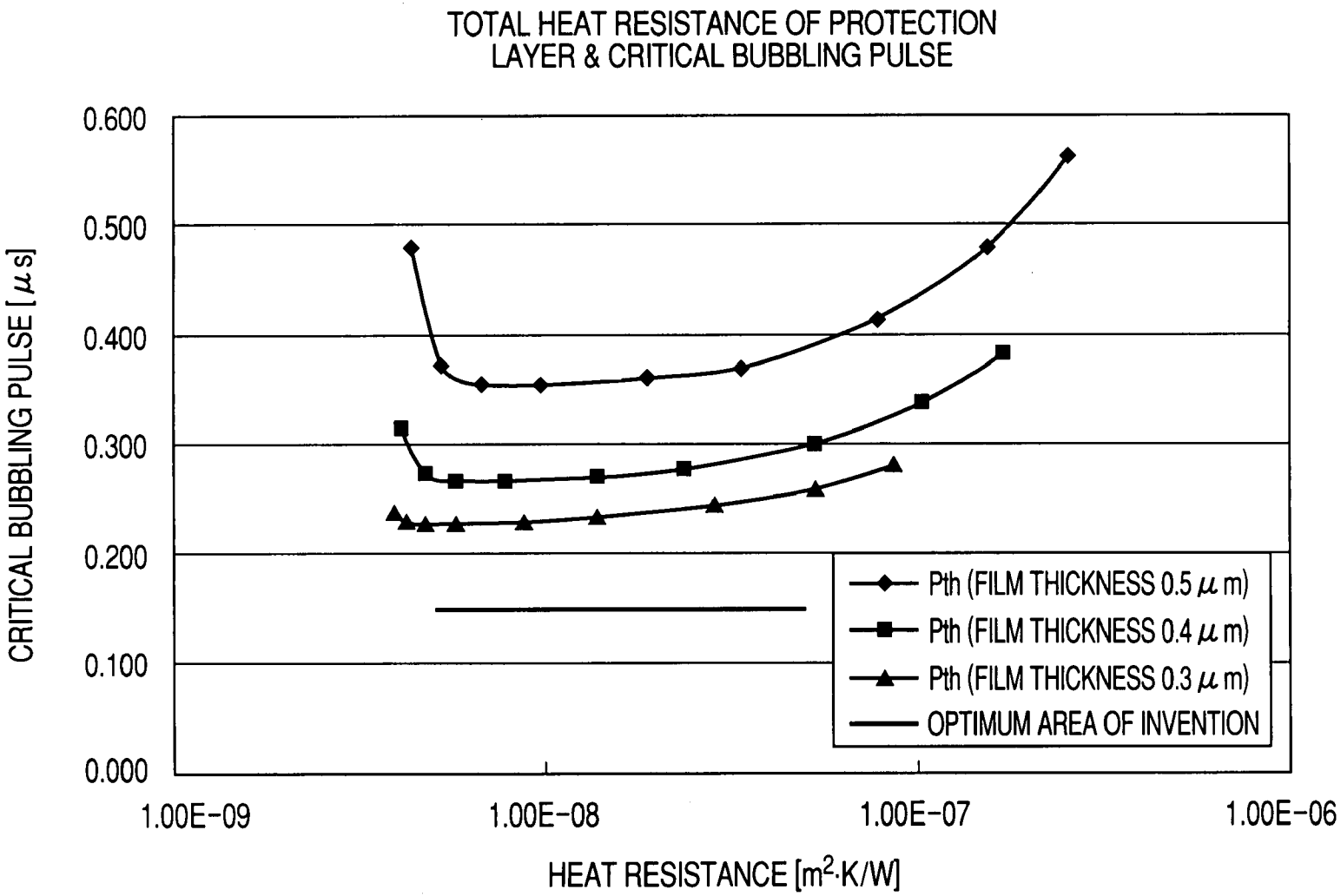
FIG. 1 is a graph for explaining a general outline of the invention and for showing a relationship between a heat resistance and a critical bubbling pulse width in simulation.

With reference to the layer above the heat generating resistance member, in order to evenly transfer the heat to the ink, the protection film is formed so that heat conductivity is relatively low and the film thickness is thinned. The protection film also has a function of electrically insulating the heat generating resistance member from the ink. When the protection film has the thickness lower than 0.2 μm, there is a possibility that cut-off is easy to occur in the protection film by a step having the thickness of the electrode wiring, which is generated in a boundary portion between the electrode wiring and the heat generating resistance member. When the protection film is too thick, the heat generated in the heat generating resistance member is difficult to be transferred to the ink to worsen energy efficiency.

On the other hand, the layer below the heat generating resistance member is determined by a manufacturing method or durability of the heat generating resistance member. An idea of shortening the drive energization time (pulse width) of the heat generating resistance member has been proposed from a viewpoint of high-speed recording. For example, when 16-divided drive is performed at a drive frequency of 30 kHz, it is necessary to drive the pulse lower than about 2 μs. In consideration of a margin of the drive, the shorter pulse is preferable. The drive energization time is shortened, and heat flux is increased, thereby the bubbling can stably be obtained. The stable bubbling has a large effect in the discharging method in which the bubble is communicated with atmosphere. Accordingly, in the high-quality recording ink jet head, it is necessary that the drive energization time ranges from about 0.5 to about 1.2 μs. The discharge efficiency can further be improved by dividing the drive pulse into the plurality of pulses to perform double pass or triple pass.

As high-quality recording progresses in the recording apparatus, a size of discharged droplet is currently reduced to the micro droplet having a volume of several picoliters. Therefore, it is necessary to increase discharge quantity to input energy, namely the discharge efficiency to an extent of several times to ten times when compared with the conventional art, which results in the difficult problem.

In order to avoid the problem, a technique of thinning the protection film on the heat generating resistance member is realized. However, as described above, in order to maintain the insulation state at the step of the lead with high reliability, the thickness of the protection film has the limitation as thin as 0.2 μm in consideration of variations in production. Even if a material having good heat conductivity is used as the protection film, sometimes the insulation properties are insufficient, and the heat spreads toward an in-plane direction on the surface of the protection film. This results in a vicious cycle of the decrease in efficiency. The appropriate thickness and heat conductivity are unknown in the protection film.

The cavitation-resistant film made of Ta is formed on the surface of the protection film in order to prevent discharge degradation caused by a thermal reaction of the ink or by the adhesion of "kogation" which is generated by carbonization of ink compositions. The use of a noble metal material such as Ir exhibiting high durability to the cavitation-resistant film is studied in order to improve the cavitation-resistant characteristics. However, because Ir has the high heat conductivity, the heat energy generated by the heat generating resistance member spreads toward the in-plane direction of the film when the film thickness of Ir is increased in order to provide the sufficient covering characteristics, which results in the problem in that the discharge efficiency is decreased. The appropriate thickness and heat conductivity are unknown in the cavitation-resistant film.

Further, in order to improve the efficiency or the durability of the heat generating resistance member in a pseudo manner, there is a method for increasing the number of heat generating resistance members. However, when the number of heat generating resistance members is increased, not only the size of the base body is increased because a considerable number of drive circuits and memories are required, but also a drive IC of the apparatus main body is highly integrated and software becomes complicated due to the complicated drive, which results in cost increase.

The invention is made in view of the above problems in the conventional art. Referring to the accompanying drawings, preferred embodiment of the invention will be described below.

The term of "heat generating member" or "heat generating resistance member" shall mean not the whole of the layer formed on the heat accumulation layer, but a part of the layer where the heat generated by the energization is transferred to the ink, namely the part which is directly in contact with the ink to heat the ink unless the protection film is formed.

General Outline of Ink Jet Head of the Invention (Study by the Inventors)

A general outline of an embodiment of the invention will first be described. The embodiment of the invention has a configuration in which the protection film on the heat generating resistance member has the proper heat resistance. In the ink jet head having the film structure shown in FIG. 15, assuming that the empirically optimum value of the protection film thickness on the heat generating resistance member ranges from 0.3 μm (3000 Å) to 0.5 μm (5000 Å) from viewpoints of insulation reliability and cavitation-resistant characteristics, the total heat resistance of the protection film is changed by changing the heat conductivity of the protection film, and the change in bubbling efficiency caused by the change in heat conductivity of the protection film is computed using the three-dimensional heat conductivity simulation. The results of the change in bubbling efficiency are shown in FIG. 1.

FIG. 1 is a graph showing a relationship between a heat resistance value of the protection film and a critical bubbling pulse width. The critical bubbling pulse is an indicator of the heat conductivity, and the critical bubbling pulse is minimum drive energization time necessary to discharge the ink. At this point, the thickness of the heat generating resistance member is set to 0.05 μm, the thickness of an electrode wiring is set to 0.2 μm, and the electrode wiring is made of aluminum. For the heat flux, the input energy per unit area in the heat generating resistance member is set to $4.55\times10^{16}$ $W/m^3$. This corresponds to the case in which a resistance value is 100 Ω and the current of 120 mA is passed in a square heat generating resistance member having a side of 26 μm. At this point, it is assumed that a time during which the water at room temperature located directly above the center of the heat generating resistance member reaches 300° C. is computed to be referred to as critical bubbling pulse. In FIG. 1, as the critical bubbling pulse width is decreased, the bubbling is generated with the smaller energy, so that bubbling efficiency of the heat generating resistance member is improved.

As can be seen from FIG. 1, the same tendencies are shown in the film thicknesses of 0.3 μm (3000 Å), 0.4 μm (4000 Å), and 0.5 μm (5000 Å), and the critical bubbling pulse width becomes the minimum when the heat resistance value of the protection film ranges from about $5\times10^{-9}$ $m^2\cdot K/W$ to about $10\times10^{-9}$ $m^2\cdot K/W$. That is, the maximum point in which the bubbling efficiency of the heat generating resistance member is maximized is found. In the conventional protection film formed by the SiN electrical insulation film having the thickness of 0.3 μm and the Ta cavitation-resistant film having the thickness of 0.23 μm, the heat resistance value is about $2.5\times10^{-7}$ $m^2\cdot K/W$. This shows that, in the thin protection film whose thickness ranges from 0.3 μm to 0.5 μm, even if the heat resistance value is decreased to the above range, the heat energy generated by the heat generating resistance member does not disperse in the in-plane direction and the bubbling efficiency is improved.

When the heat resistance value is further decreased lower than the above range, the critical bubbling pulse width is increased, and the bubbling efficiency becomes worsened. This shows that the heat energy generated by the heat generating resistance member disperses in the in-plane direction of the protection film even in the thin protection film whose thickness ranges from 0.3 μm to 0.5 μm.

Further, as can be seen from FIG. 1, an area where the critical bubbling pulse width is minimized is relatively broad and the bubbling efficiency is not largely changed up to about $50\times10^{-9}$ $m^2\cdot K/W$ which is higher than $10\times10^{-9}$ $m^2\cdot K/W$. Needless to say, the most preferable heat resistance value ranges from $5\times10^{-9}$ $m^2\cdot K/W$ to $10\times10^{-9}$ $m^2\cdot K/W$.

FIG. 1 also shows the result of the simulation when the thickness of the protection film ranges from 0.3 μm to 0.5 μm, and the simulation confirms that similar characteristics are shown when the thickness of the protection film ranges from 0.2 μm to 0.6 μm.

Figure 15:
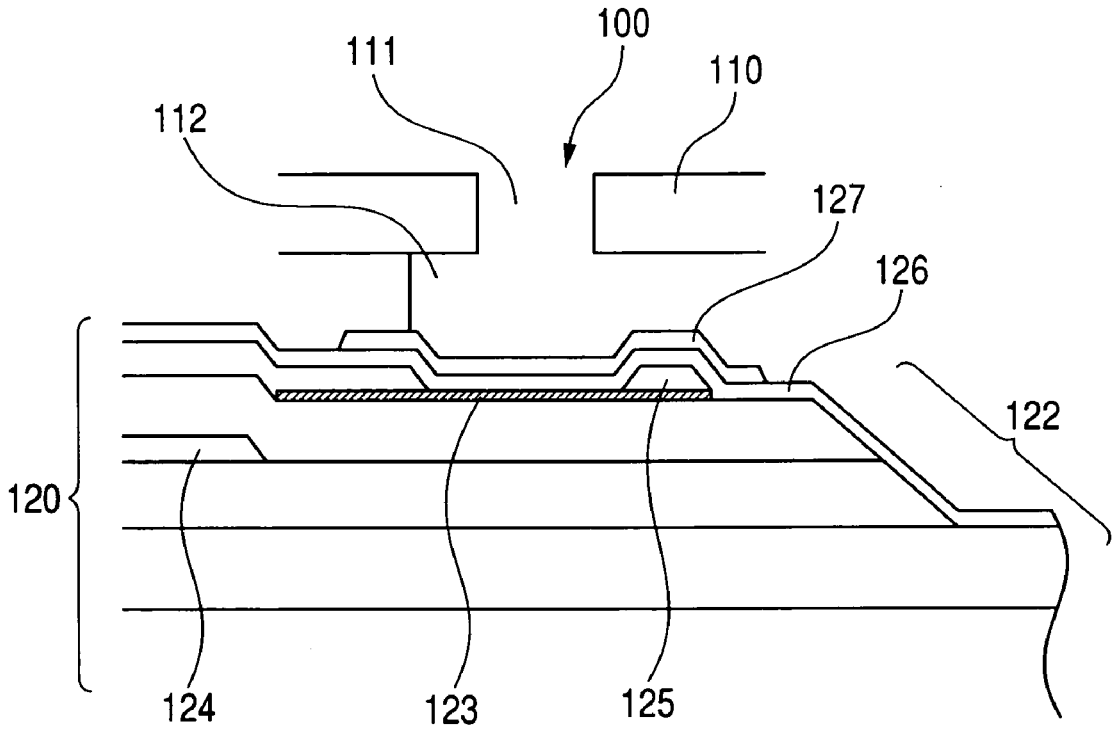
FIG. 15 is a schematic sectional view showing a heat generating resistance member of the conventional ink jet head.
Figure 16:
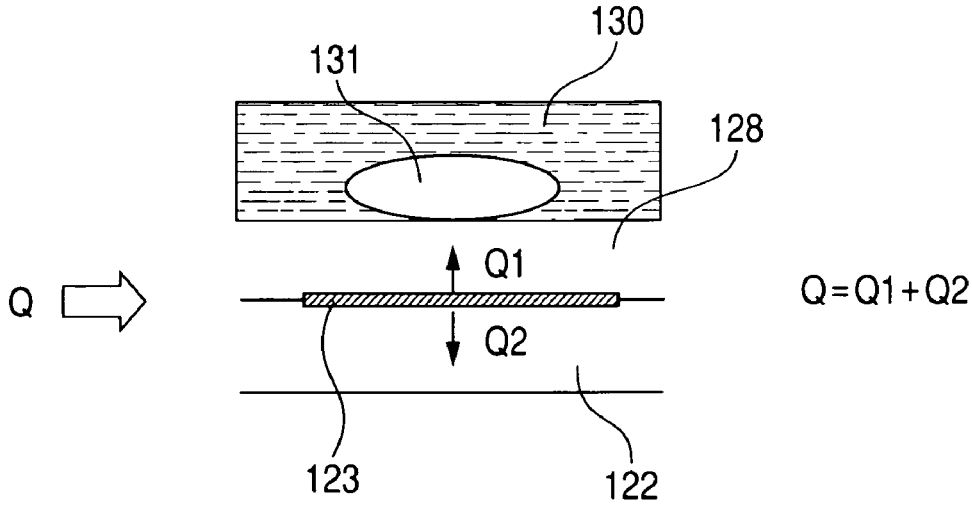
FIG. 16 is a schematic view for explaining a principle of heat transfer in the ink jet head.

In order to realize the above heat resistance values, the heat conductivity of the protection film is calculated. The cavitation films shown in FIG. 15 are used (material: Ta, and film thickness: 0.23 μm) so that conditions for the conventional ink jet head are not changed as much as possible, and the thickness (0.1 μm (1000 Å), 0.2 μm (2000 Å), and 0.3 μm (3000 Å)) and the heat conductivity of the protection film are changed to perform the computation again. This is because the heat conductivity of Ta constituting the cavitation-resistance film is larger than that of SiN constituting the insulation film, so that Ta has little effect on the bubbling efficiency, namely the bubbling efficiency depends mainly on the insulation film. The heat conductivity of the thin film is changed depending on the film thickness or a deposition process. However, the specific value of the heat conductivity used for the simulation is one which is usually obtained from references. 54 W/m·K is used as the heat conductivity of the thin film Ta, and 1.2 W/m·K is used as the heat conductivity of the thin film SiN. For example, although the heat conductivity of the thin film SiN is changed in the range from about 1.2 to about 32 W/m·K, the heat conductivity of the thin film SiN is still lower than the heat conductivity of Ta.

Figure 2:
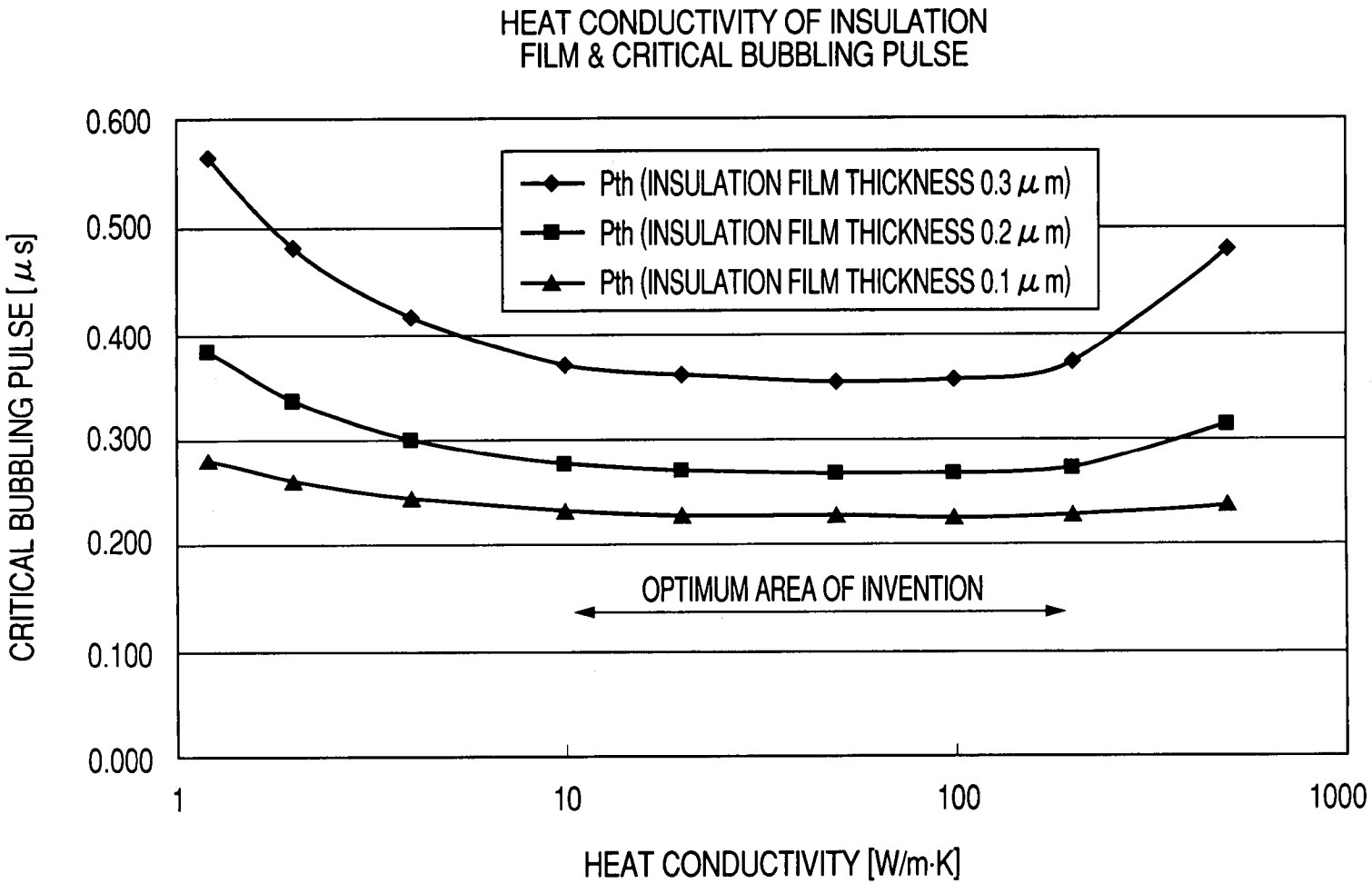
FIG. 2 is a graph for explaining a general outline of the invention and for showing a relationship between a heat conductivity and the critical bubbling pulse width in simulation.

FIG. 2 shows a relationship between the heat conductivity and the critical bubbling pulse width, which is determined by the simulation. As can be seen from FIG. 2, the critical bubbling pulse width is minimized when the heat conductivity of the insulation film ranges from 10 to 200 W/m·K. In the range from 10 to 200 W/m·K, it is found that the critical bubbling pulse width is not substantially changed and the good bubbling efficiency is obtained. Although FIG. 2 shows the result of the simulation when the thickness of the insulation film ranges from 0.1 to 0.3 μm, the same characteristics are also obtained when the thickness of the insulation film ranges from 0.3 to 0.4 μm.

Figure 3:
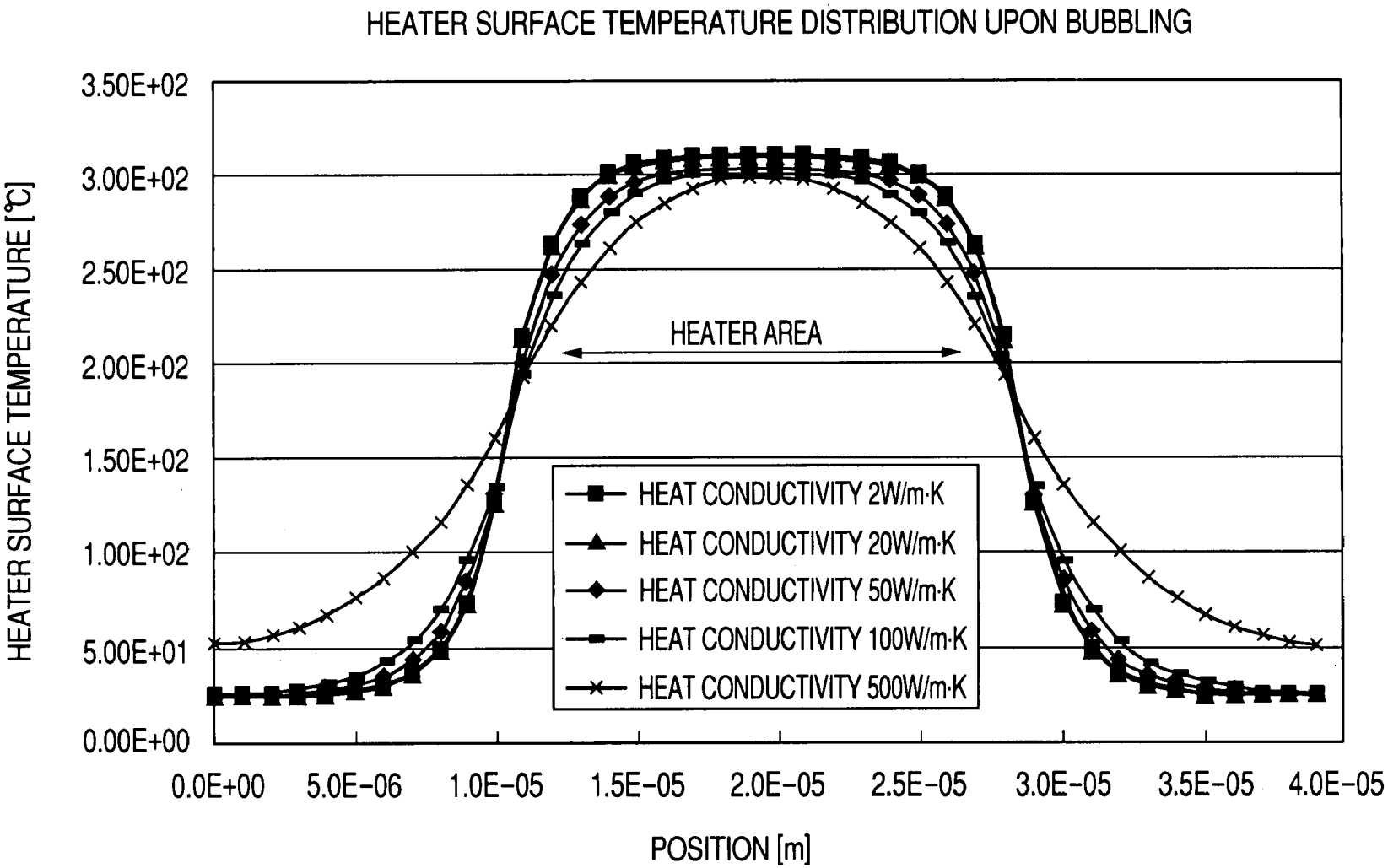
FIG. 3 is a graph for explaining a general outline of the invention and for showing a surface temperature distribution of heat generating resistance member in simulation.

When the thickness of the insulation film is 0.3 μm, FIG. 3 shows a temperature distribution on the protection film which is in contact with the water, when the water directly above the heat generating resistance member becomes about 300° C., namely immediately before the bubbling by changing the heat conductivity of the insulation film in the range from 2 to 500 W/m·K. As can be seen from FIG. 3, as the heat conductivity is increased, a surface area of the heat generating resistance member whose temperature becomes 300° C. is decreased. This is because, as described above, the heat energy generated by the heat generating resistance member disperses in the in-plane direction when the heat conductivity is high. According to FIG. 3, the dispersion of the heat energy toward the in-plane direction does not occur substantially up to the heat conductivity of about 100 W/m·K, and the simulation result is similar to the heat conductivity of the insulation film in the conventional ink jet head. However, when the heat conductivity becomes about 500 W/m·K, it is found that an equilibrium area of 300° C. is substantially eliminated and the heat energy disperses in the in-plane direction.

Thus, when the protection film is formed by the insulation film and the Ta cavitation-resistant film, in order to improve the bubbling efficiency, it is preferable that the heat conductivity of the insulation film ranges from 10 to 200 W/m·K, it is more preferable that the heat conductivity of the insulation film ranges from 10 to 100 W/m·K, and it is most preferable that the heat conductivity of the insulation film ranges from 10 to 50 W/m·K.

Referring to FIGS. 1 and 2 again, the critical bubbling pulse width ranges from about 0.2 to about 0.6 μs. However, when the bubbling of the ink is actually performed to discharge the ink, in consideration of the variations in production, the drive pulse in which the critical bubbling pulse width is increased at a constant ratio is provided, so that the drive pulse becomes substantially equal to the conventional drive condition ranging from 0.5 to 1.2 μs, which is of the proper condition of the high heat flux in order to perform the stable discharge in the discharging method in which the bubble is communicated with the atmosphere. Further, in consideration of not only the variations in production of the ink jet head, but also of temperature environment in which the ink jet head is actually used, it is desirable that the drive pulse width for discharging the ink ranges from 0.2 to 2.0 μs.

Figure 4:
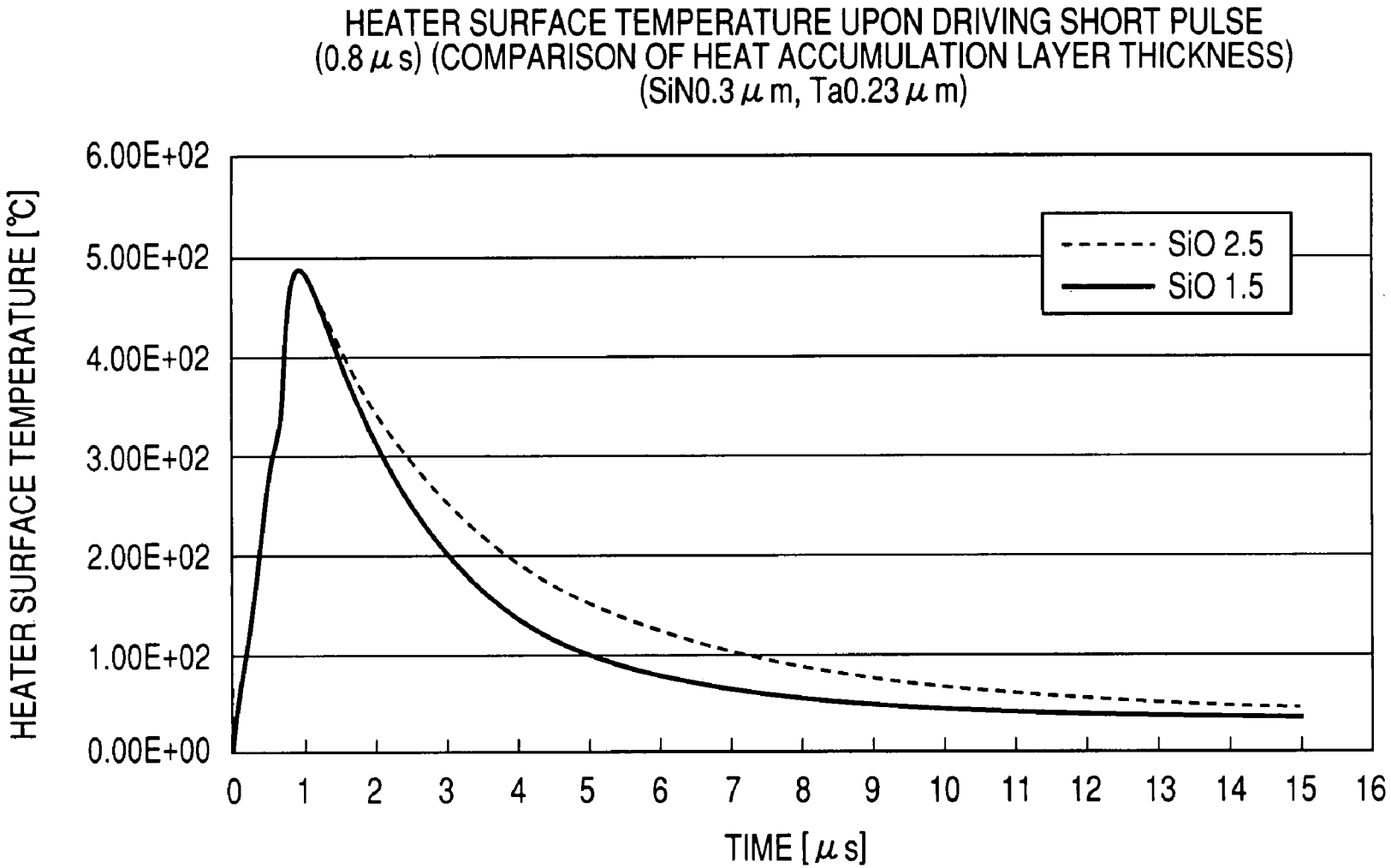
FIG. 4 is a graph for explaining a general outline of the invention and for showing a relationship between an elapsed time and a surface temperature of heat generating resistance member in simulation when a heat generating resistance member is driven at a pulse of 0.8 μs.

The present inventors study an influence of the heat accumulation layer on the heat transfer efficiency of the ink. In the ink jet head having the film structure shown in FIG. 15, on the conditions that the protection film is formed by the SiN film (insulation film) whose thickness is 0.3 μm and the Ta film (cavitation-resistant film) whose thickness is 0.23 μm, when the heat generating resistance member is driven with the drive pulse width of 0.8 μs, the change in surface temperature and the elapsed time since the drive pulse is applied to the heat generating resistance member is computed for the case where the heat accumulation layer is formed by the $SiO_2$ film whose thickness is 2.5 μm and the case where the heat accumulation layer is formed by the $SiO_2$ film whose thickness is 1.5 μm using a three-dimensional heat conduction simulation. FIG. 4 shows the result of the simulation.

As can be seen from FIG. 4, when the two heat accumulation layers are compared to each other, the two heat accumulation layers are similar to each other in that the maximum peak temperature is about 500° C., and the temperature is rapidly decreased in the heat accumulation layer formed by the $SiO_2$ film whose thickness is 1.5 μm. From these results, it is thought that the heat conductivity to the ink is not decreased even if the thickness of the heat accumulation is decreased.

Figure 5:
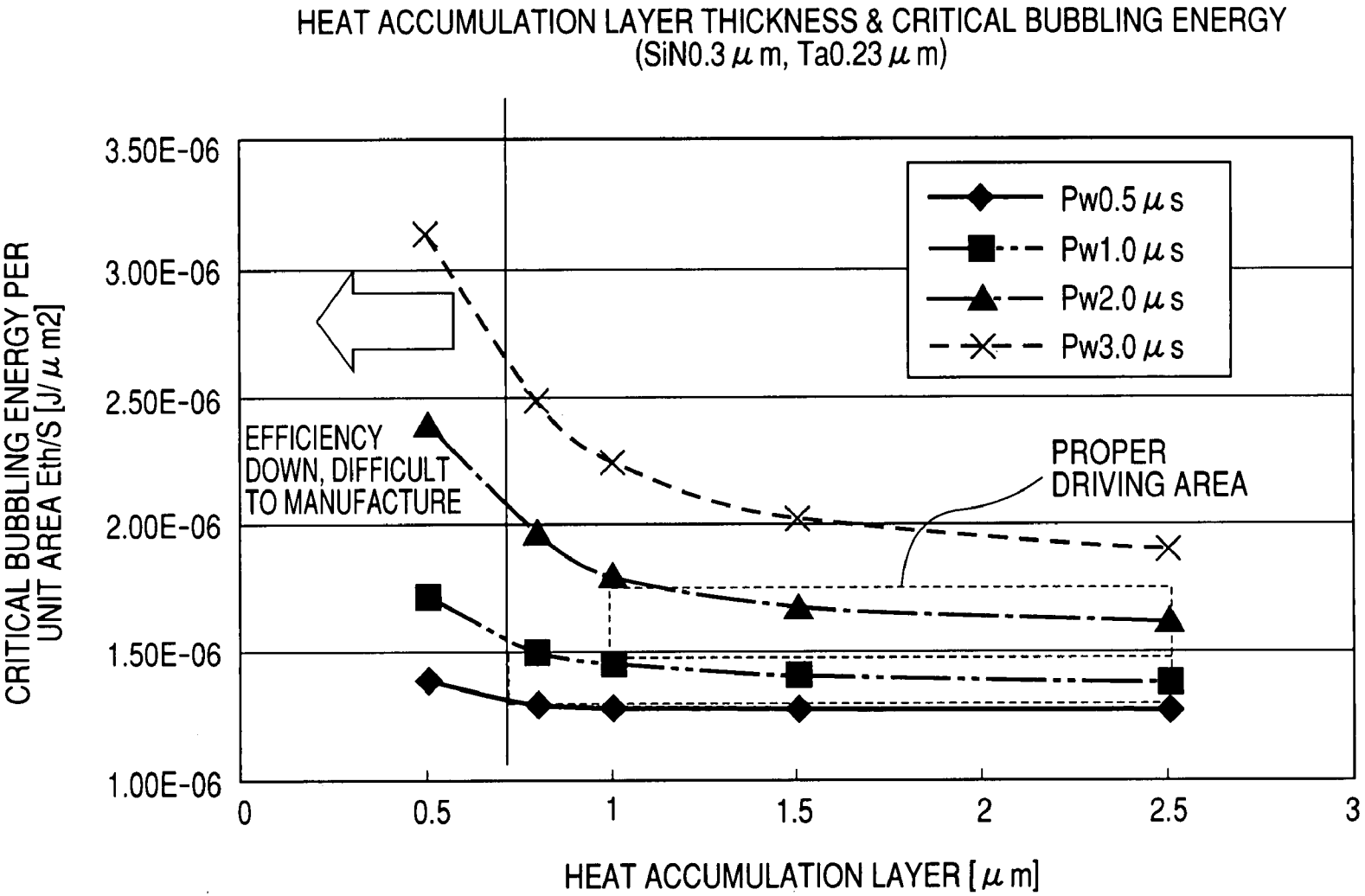
FIG. 5 is a graph for explaining a general outline of the invention and for showing a relationship between a heat accumulation layer and critical bubbling energy per unit area of a heat generating resistance member in simulation.

Then, how much the heat accumulation layer can be decreased without decreasing the heat transfer effect to the ink is computed using the three-dimensional heat conduction simulation. FIG. 5 shows the result of the simulation.

FIG. 5 is a graph showing a relationship between the thickness of the heat accumulation layer and ink critical bubbling energy per unit area of the heat generating resistance member, which is obtained by the simulation. The ink critical bubbling energy per unit area of the heat generating resistance member is an index of the heat transfer efficiency to the ink. The ink critical bubbling energy is the critical heat energy which is necessary for the surface temperature of the heat generating resistance member to exceed 300° C. which is of the bubbling temperature of the ink. As the ink critical bubbling energy is increased, the heat transfer efficiency becomes worsened. The computation is performed while the heat energy applying time (Pw) which is of the drive energization time is change in the range of 0.5 μs to 3.0 μs. From a viewpoint of recording speed of the ink jet head, it is necessary to drive the ink jet head at high speed. From a viewpoint of drive pulse accuracy, it is necessary that the heat energy applying time is not too short. Therefore, the heat energy applying time is appropriately obtained from these conditions. The heat energy applying time includes the appropriate condition of the high heat flux in order to perform the stable discharge in the discharging method in which the bubble is communicated with the atmosphere, namely the drive energization time ranging from 0.5 to 1.2 μs.

As can be seen from FIG. 5, when the thickness of the heat accumulation layer is lower than about 0.7 μm, the heat transfer efficiency to the ink is abruptly worsened. From FIG. 5, it is found that the thickness of at least 0.7 μm is required for the heat accumulation layer. In the heat accumulation layer whose thickness is lower than 0.7 μm, it is difficult to stably perform the deposition.

Further, FIG. 5 shows that the heat transfer efficiency is worsened as the heat energy applying time (Pw) is increased, and that the influence of the thickness of the heat accumulation layer is increased as PW is increased. Specifically, when Pw ranges from 1.2 μs to 2 μs, the heat transfer efficiency is not decreased as long as the thickness of the heat accumulation layer is not lower than 1.0 μm. When Pw is not more than 1.2 μs which is of the condition of the high heat flux, the heat transfer efficiency is not decreased even if the thickness of the heat accumulation layer is not lower than 0.7 μm.

Thus, when the protection film is formed by the SiN film whose thickness is 0.3 μm and the Ta film whose thickness is 0.23 μm, in order to secure the good heat transfer efficiency, it is preferable that the thickness of the heat accumulation layer made of $SiO_2$ is not lower than 1.0 μm. For the drive energization time, when Pw is not more than 1.2 μs, it is preferable that the thickness of the heat accumulation layer is not lower than 0.7 μm. The drive energization time is not limited to one pulse, and it is possible that the pulse is divided into the plurality of pulses to perform the pulse drive. In this case, the total energization time of each pulse width corresponds to Pw. The relationship shown in FIG. 5 is also obtained in the later-mentioned sample head.

Although the materials and the thicknesses of the protection layer and the heat accumulation layer are specifically shown as an example, the invention is not limited to the above examples. The invention is one in which the applied heat energy is efficiently transferred to the ink, so that a heat resistance ratio can be substituted for the above-described conditions.

Figure 6:
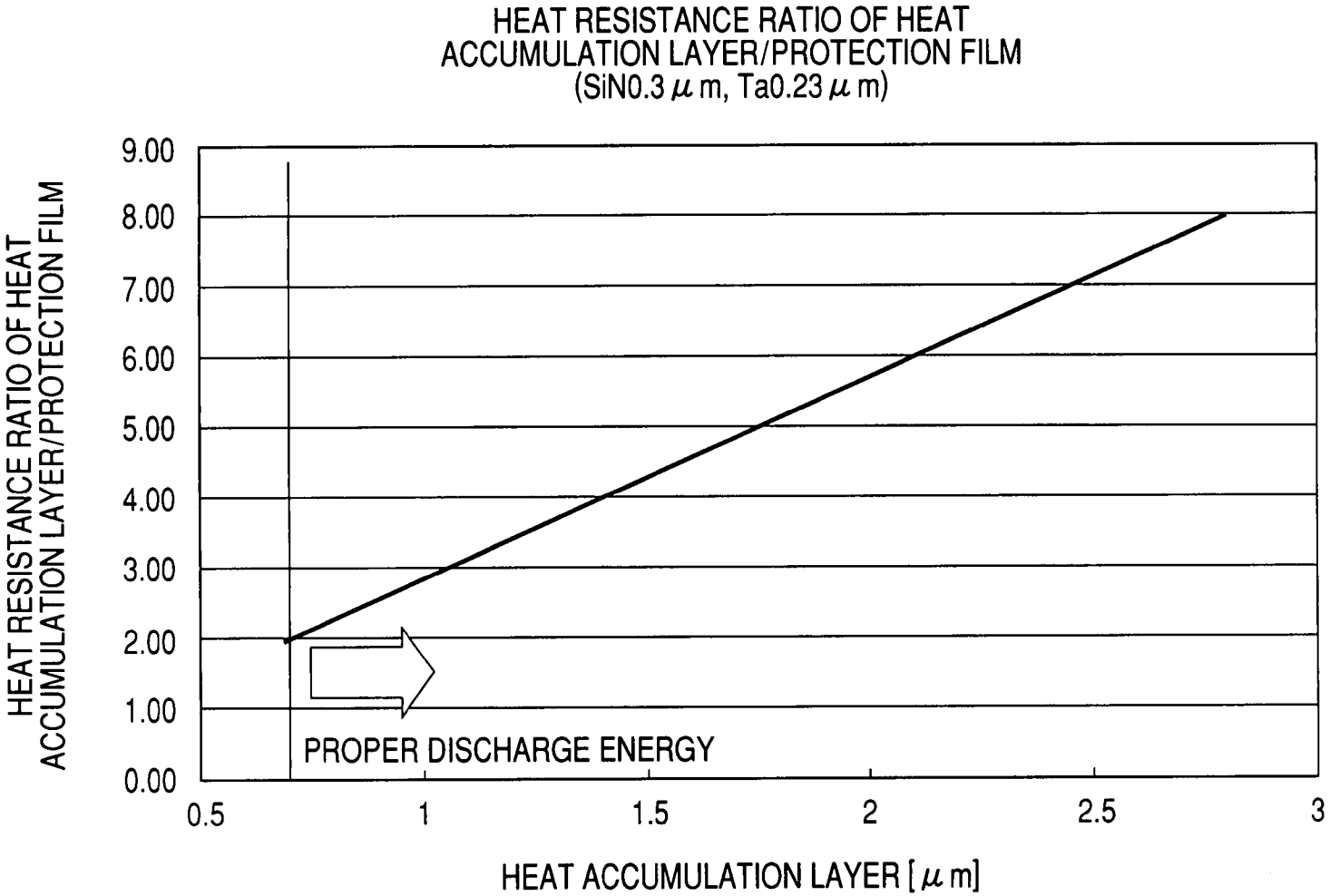
FIG. 6 is a graph for explaining a general outline of the invention and for showing a relationship between a heat accumulation layer and a heat resistance ratio of heat accumulation layer/protection film in simulation.

FIG. 6 shows the substitution result. FIG. 6 shows a relationship between the thickness of the heat generating resistance member accumulation layer and the heat resistance ratio of heat accumulation layer/protection film, in which the heat resistance ratio of the heat accumulation layer to the protection film is substituted for the condition of the heat accumulation layer in the above-described conditions of the protection film. For the heat conductivity of each film, the SiN thin film and the Ta thin film are set to the values described above, and the $SiO_2$ thin film is set to 1.38 W/m·K which is generally obtained from the references. A heat resistance value Rs of the thin film is given by Rs=d/K, where d is the film thickness and K is the heat conductivity of the material constituting the thin film. The heat resistance value of the multi-layered film is one in which the heat resistance values of the films constituting the multi-layered film are added.

As can be seen from FIG. 6, in the protection film formed by the SiN film whose thickness is 0.3 μm and the Ta film whose thickness is 0.23 μm, at least about the double heat resistance ratio of heat accumulation layer/protection film can be substituted for the condition that the thickness of the heat accumulation layer is not lower than 0.7 μm. Therefore, it is preferable that the ratio of the heat resistance of the heat accumulation layer to heat resistance of the protection film is more than two times.

The above-described relationships are obtained by the simulation. However, even in the ink jet head which is actually produced, the result similar to the result obtained by the simulation is obtained for the heat conductivity and the bubbling efficiency.

Inkjet Recording Apparatus

Then, an ink jet recording apparatus on which an ink jet head according to the invention is mounted will be described referring to FIG. 13.

Figure 13:
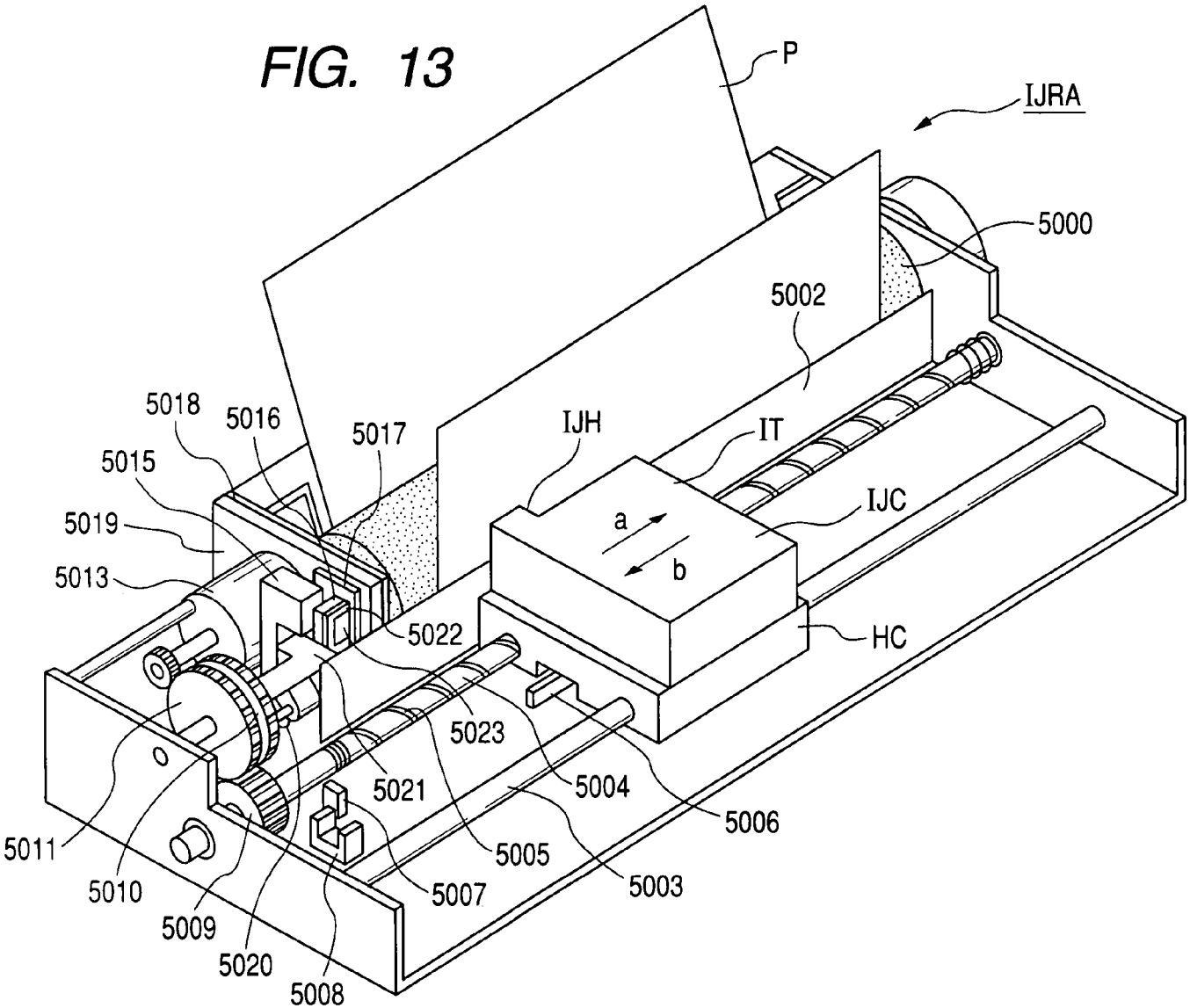
FIG. 13 is a perspective view showing an example of an ink jet recording apparatus of the invention.

FIG. 13 is a perspective view schematically showing an example of the ink jet recording apparatus of the invention. In FIG. 13, a lead screw 5004 in which a spiral groove 5005 is made is journaled in a main body frame. The lead screw 5004 is connected with normal and reverse rotations of a drive motor 5013, and the lead screw 5004 is rotated through drive force transfer gears 5009 to 5011.

A guide rail 5003 which slidably guides a carriage HC is fixed to the main body frame. A pin (not shown) which engages the spiral groove 5005 is provided in the carriage HC. The carriage HC can reciprocally be moved in directions of an arrow a and an arrow b by rotating the lead screw 5004 by the rotation of the drive motor 5013. A paper pressing plate 5002 presses a recording medium P against a platen 5000 across the moving direction of the carriage HC.

An ink jet recording unit IJC is mounted on the carriage HC. It is possible that the ink jet recording unit IJC has a form in which the ink jet head is integrated with an ink tank IT, or it is possible that the ink jet recording unit IJC has the form in which the ink jet head and the ink tank IT are separately formed and detachably combined. The ink jet recording unit IJC is fixed to and supported by the carriage HC with positioning means and an electrical contact which are provided in the carriage HC, and the ink jet recording unit IJC is provided while being detachable to the carriage HC.

Photocouplers 5007 and 5008 constitute home position detecting means which confirms existence of a lever 5006 of the carriage HC in this area to reverse a rotating direction or the like of the drive motor 5013. A capping member 5022 which caps a front face (surface in which discharge ports are opened) of the ink jet head is supported by a supporting member 5016. The capping member 5022 includes a sucking means 5015, and the capping member 5022 sucks and recovers the ink jet head through a cap inner opening 5023. A support plate 5019 is attached to a main body support plate 5018, and a cleaning blade 5017 slidably supported by the support plate 5019 is moved in a fore-and-aft direction by driving means (not shown). The form of the cleaning blade 5017 is not limited to one which is shown in FIG. 13, and it is also possible that the well-known cleaning blade is applicable. A lever 5021 is one which starts the suction and recovery operation of the ink jet head. The lever 5021 is moved according to the movement of a cam 5020 abutting on the carriage HC, and the drive force from the drive motor 5013 is controlled by well-known transferring means such as a gear 5010 and a latch switch.

Each of the capping, the cleaning, and the sucking and recovering processes is performed at each corresponding position by working of the lead screw 5004 when the carriage HC is moved to the home position side area. When the desired operation is performed at predetermined timing, each process can be applied to the invention.

Figure 14:
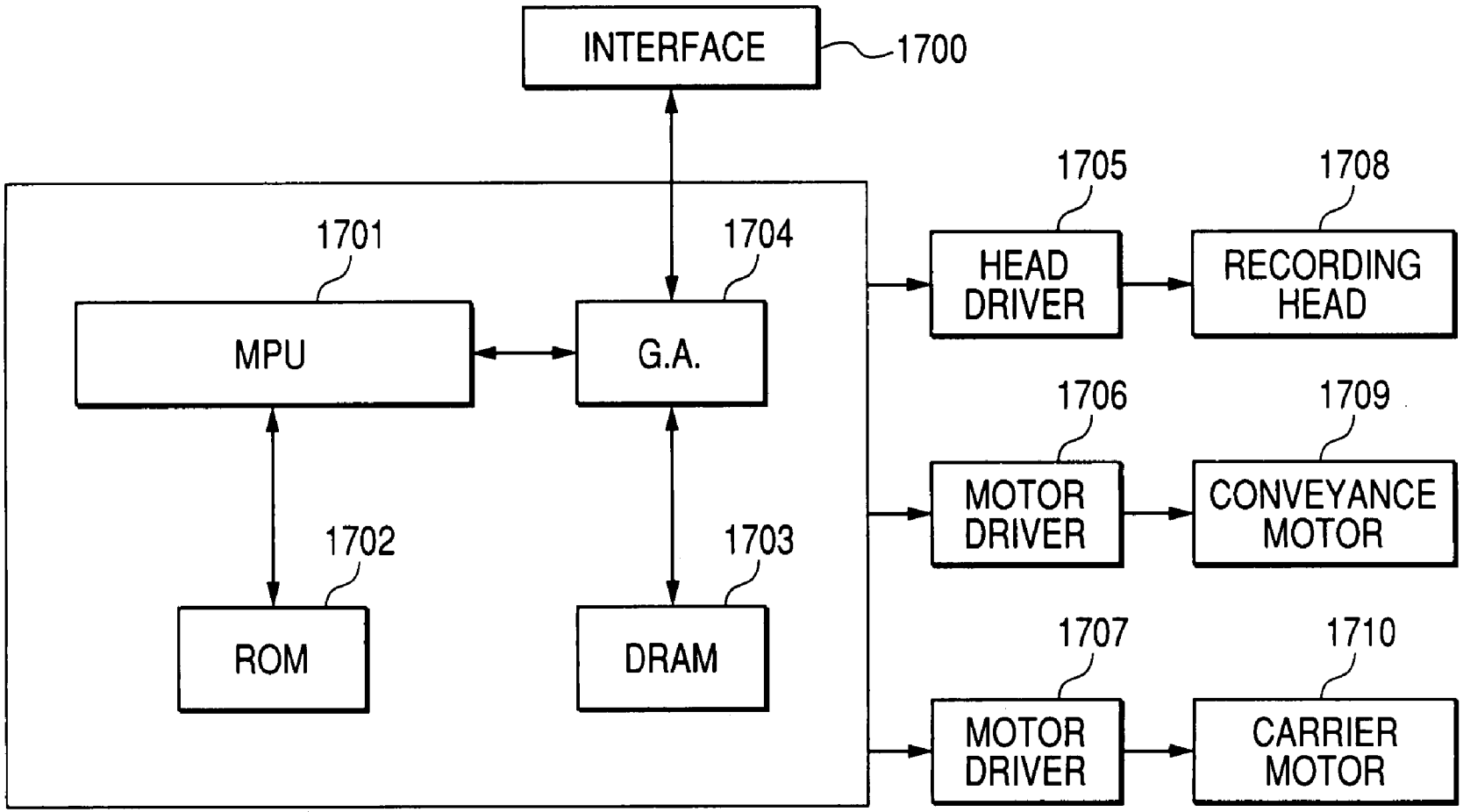
FIG. 14 is a block diagram showing an example of a control circuit which controls operation of the ink jet recording apparatus shown in FIG. 13.

FIG. 14 shows a block diagram of a control circuit which controls the operation of the ink jet recording apparatus. The control circuit shown in FIG. 14 has an interface 1700 to which a recording signal is input from an external apparatus such as a computer, a control unit which controls the operation of the ink jet recording apparatus based on the recording signal input through the interface 1700, a head driver 1705 which drives a recording head (ink jet head) 1708, a motor driver 1706 which drives a conveying motor 1709 which conveys the recording medium (rotates the platen 5000 shown in FIG. 14), and a motor driver 1707 which drives a carrier motor 1710 (corresponding to the drive motor 5013 of FIG. 13).

The control unit has a gate array (G.A.) 1704 which receives the recording signal from the interface 1700 to control provision of recording data to the recording head 1708, MPU 1701, ROM 1702 in which a control program executed by MPU 1701 is stored, and DRAM 1703 in which the recording signal and various kinds of data such as the recording data provided to the recording head 1708 are stored. The gate array 1704 also controls the data transfer between MPU 1701 and DRAM 1703.

When the recording signal is input to the interface 1700, the recording signal is converted into the recording data for the recording between the gate array 1704 and MPU 1701. While the motor drivers 1706 and 1707 drive the conveying motor 1709 and the carrier motor 1710 respectively, the recording head 1708 is driven according to the recording data transmitted to the head driver 1705, and the recording is performed. The drive energization time of the heat generating resistance member is also controlled by MPU 1701.

Inkjet Head

Then, an example of an ink jet head which is preferably used to the invention will be described.

CONFIGURATION EXAMPLE 1 OF INKJET HEAD

Figure 7:
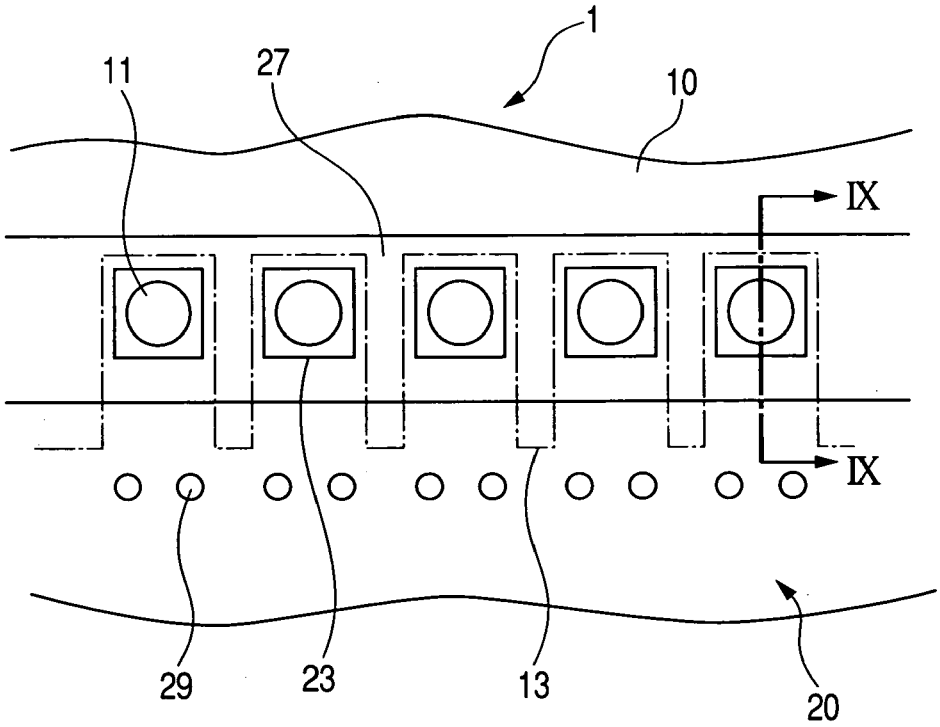
FIG. 7 is a plan view showing a main part of an example of an ink jet head preferably used for the invention when viewed from a discharge port side.
Figure 8:
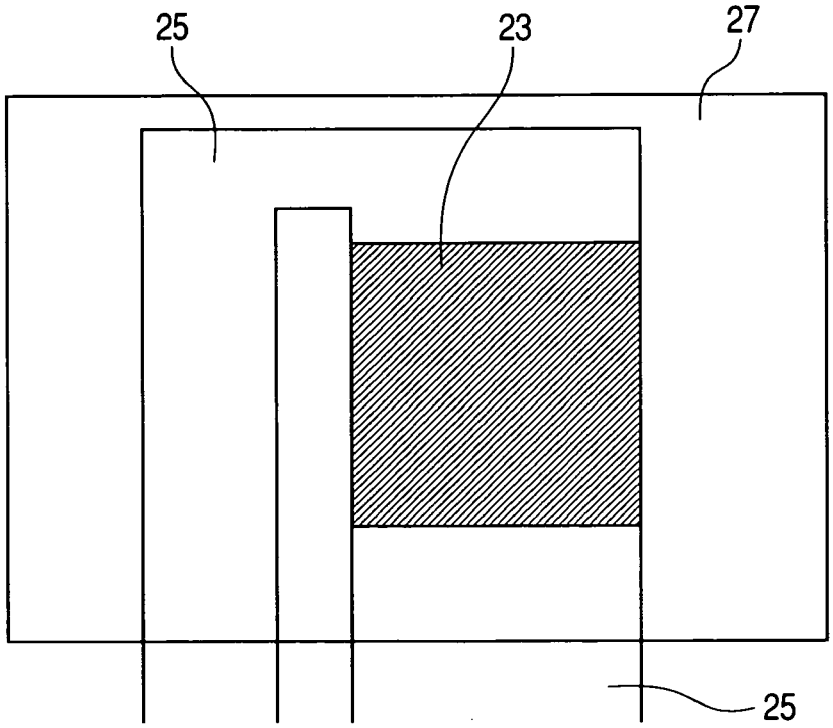
FIG. 8 is an enlarged plan view showing a heat generating resistance member on a base body shown in FIG. 7.

FIG. 7 is a plan view showing a main part of an example of the ink jet head preferably used for the invention when viewed from the discharge port side, and FIG. 8 is an enlarged plan view showing one heat generating resistance member shown in FIG. 7. In FIG. 7, in order to understand an inner structure, a nozzle material 10 is shown as a perspective drawing.

An ink jet head 1 has a base body 20 in which a plurality of heat generating resistance members 23 are formed and the nozzle material 10 which is connected to the base body 20. The heat generating resistance members 23 are arranged in line. However, in the case of a color ink jet head, it is possible that a plurality of lines of heat generating resistance members 23 are arranged in each color. In the nozzle material 10, a discharge port 11 is formed at the opposite position to each heat generating resistance member 23 while the center of the discharge port is located above the center of the heat generating resistance member 23. A nozzle wall 13 which separates the adjacent heat generating resistance members 23 from each other is formed in the nozzle material 10, and a liquid path in which the discharge port 11 is opened is formed in each heat generating resistance member 23 by bonding the base body 20 and the nozzle material 10.

In order to supply the ink from the outside of the ink jet head 1 onto each heat generating resistance member 23, supply port (not shown) is formed in the base body 20 while piercing through the base body 20. The supply port is opened to an ink chamber which is common to each liquid path. A filter 29 which is of a columnar structure is provided between the ink chamber and each channel in order to prevent the invasion of a foreign material into the channel. The insulation film (not shown in FIG. 8) and a cavitation-resistant film 27 are provided while all the heat generating resistance members 23 arranged in line are covered with both the insulation film and the cavitation-resistant film 27. As shown in FIG. 5, an electrode wiring 25 is connected to the heat generating resistance member 23.

The ink is supplied from the supply port into the channel to flow onto the heat generating resistance member 23. In this state of things, the bubbling of the ink on the heat generating resistance member 23 occurs by energizing the heat generating resistance member 23 via the electrode wiring 25 to generate the heat energy, which discharges the ink from the discharge port 11. The ink jet head 1 is referred to as a side shoot type of ink jet head in which the heat generating resistance member 23 is opposed to the discharge port 11. The discharging method for the side shoot type of ink jet head 1 mainly includes the method in which the bubble generated by driving the heat generating resistance member 23 is communicated with the atmosphere and the method in which the bubble is not communicated with the atmosphere. In the method in which the bubble is not communicated with the atmosphere, the generated bubble vanishes without communicating with the atmosphere. The invention can be applied to both the methods.

Figure 9:
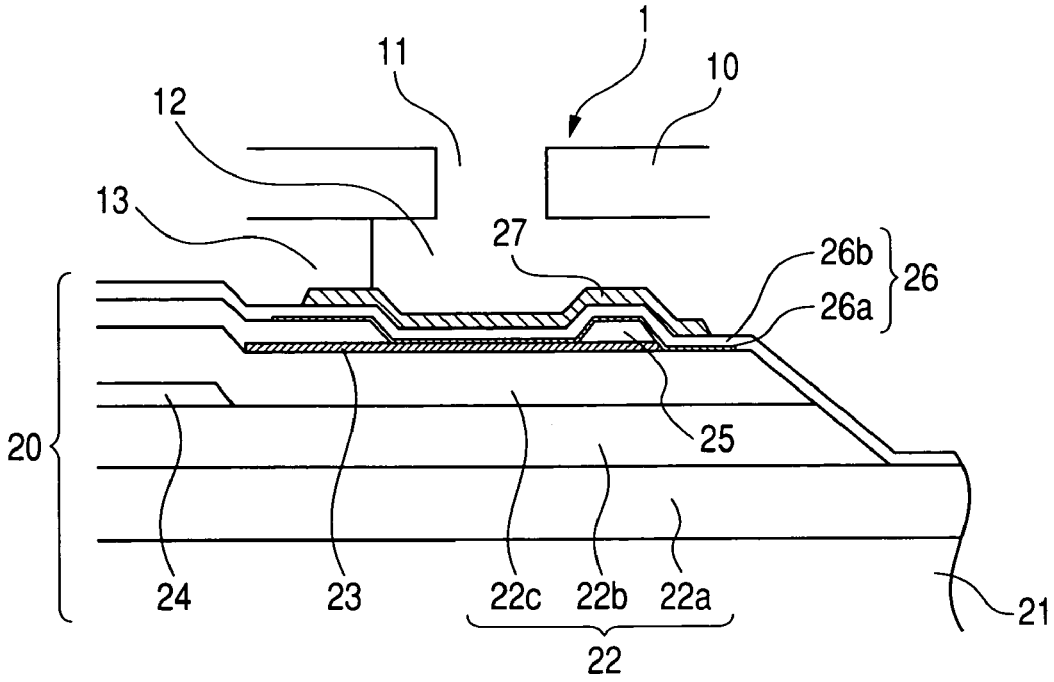
FIG. 9 is a sectional view taken on line B—B of the ink jet head shown in FIG. 7.

FIG. 9 is a sectional view taken on line IX—IX of the ink jet head shown in FIG. 7. Referring to FIG. 9, a layer structure of the base body 20 in the ink jet head 1 of the example 1 will be mainly described.

The base body 20 has a substrate 21 made of silicon, a heat accumulation layer 22 which is formed on the surface of the substrate 21 and also acts as the electrical insulation film, the heat generating resistance member 23 which is partially formed on the heat accumulation layer 22, electrode wirings 24 and 25 which provides the electric power to the heat generating resistance member 23, an insulation film 26 with which the heat generating resistance member 23 and the heat accumulation layer 22 are covered, and a cavitation-resistant film 27 which is partially formed on the insulation film 26. The heat accumulation layer 22 has a triple-layer structure in which a thermal oxide film 22*a* and interlayer films 22*b* and 22*c* are laminated in the order from the substrate 21 side. In the example 1, the thermal oxide film 22*a* and the interlayer films 22*b* and 22*c* are made of $SiO_2$, the total thickness of the heat accumulation layer 22 is set so that the total heat resistance of the heat accumulation layer 22 is not lower than double the total heat resistance of the film (insulating film 26 and cavitation-resistant film 27) formed while the heat generating resistance member 23 is covered with the film, namely the protection film. However, the material of the films constituting the heat accumulation layer 22 and the number of layers and the structure of the heat accumulation layer 22 can arbitrarily be changed in the range in which the total heat resistance satisfies the above condition. For example, at least one layer in the heat accumulation layer 22 can be formed by an $SiO_x$ film or a BPSG (Bro-Phospho Silicate Glass) film. An arbitrary method such as thermal oxidation method and a CVD method can be adopted as the deposition method.

In the example 1, the heat generating resistance member 23 is made of TaSiN. The electrode wirings 24 and 25 are made of AlCu. However, the electrode wirings 24 and 25 are not limited to the Al Cu. The electrode wirings 24 and 25 can be made of AL or Al alloys. It is possible that the thickness of the electrode wiring ranges from 0.1 to 1.0 μm.

The insulation film 26 has a double-layer structure in which an SiC film 26*b* is formed on an SiN film 26*a*. The thickness of the SiN film 26*a* is set to 0.05 μm, and the thickness of the SiC film 26*b* is set to 0.2 μm. Thus, the heat resistance can be decreased and the insulation reliability can be optimized with respect to the covering at the step of the electrode wiring 25 by forming the insulation film 26 with the plurality of layers. However, the structure of the insulation film 26 is not limited to the example 1. For example, it is possible that the insulation film can be formed by at least three layers, it is possible that the thickness of the SiC film 26*b* is set to the value not lower than 0.2 μm, or it is possible that the thickness of the SiN film 26*a* is set to the value not lower than 0.05 μm. The cavitation-resistant film 27 is made of Ta, and the thickness of the cavitation-resistant film 27 is set to 0.23 μm. That is, in the example1, the total thickness of the protection film on the heat generating resistance member 23 is set to 0.48 μm.

The nozzle material 10 is bonded to the base body 20 to form an ink chamber 12 between the heat generating resistance member 23 and the discharge port 11.

It is desirable that the heat resistance values of the insulation film 26 and the cavitation-resistant film 27 which are of the protection film on the heat generating resistance member 23 are set to appropriate values. In the structure of the conventional ink jet head shown in FIG. 15, the protection film is formed by the SiN insulation film whose thickness is 0.3 μm and the Ta cavitation-resistant film whose thickness is 0.23 μm. Assuming that the heat conductivity of the Ta thin film is 54 W/m·K, the heat conductivity of the SiN thin film is 1.2 W/m·K, and the heat conductivity of the SiC thin film is 70 W/m·K, when the heat resistance of the protection film in the conventional ink jet head is computed, the heat resistance value of the protection film becomes about $2.5\times10^{-7}$ $m^2$·K/W. On the other hand, in the ink jet head 1 of the example 1, the heat resistance value becomes about $48\times10^{-9}$ $m^2$·K/W. Further, in the heat accumulation layer 22, the thickness of the thermal oxide film 22*a* is set to 1.0 μm, the thickness of the interlayer film 22*b* is set to 0.8 μm, and the thickness of the interlayer film 22*c* is set to 0.7 μm. When the heat conductivity of the $SiO_2$ thin film is set to 1.38 W/m·K, the heat resistance value of the heat accumulation layer 22 becomes about $1.81\times10^{-6}$ $m^2$·K/W. Accordingly, in the example 1, the total heat resistance value of the heat accumulation layer 22 becomes about 39 times of the total heat resistance of the protection film.

In the example1, a plane size of the heat generating resistance member 23 is formed in the square of 26 μm by 26 μm. However, the size of the heat generating resistance member 23 is not limited to the example 1, and it is confirmed that the heat generating resistance member 23 formed in the square ranging from 16 μm by 16 μm to 39 μm by 39 μm can be used for the invention. The shape of the heat generating resistance member 23 is not limited to the square. The heat generating resistance member 23 can also be formed in a rectangle. The number of heat generating resistance members per one discharge port 11 can be at least two. It is possible that the heat generating resistance member 23 is formed by the two rectangular heat generating resistance members whose size is 10 μm by 24 μm while the two heat generating resistance members are connected in series.

Thus, in both the discharging method in which the bubble is communicated with the atmosphere and the discharging method in which the bubble is not communicated with the atmosphere, the same excellent effect that the heat transfer efficiency to the ink is optimized without decreasing the insulation reliability and the cavitation resistant characteristics of the protection film can be obtained by optimizing the thickness and the heat resistance value of the protection film.

CONFIGURATION EXAMPLE 2 OF INKJET

HEAD

Figure 10:
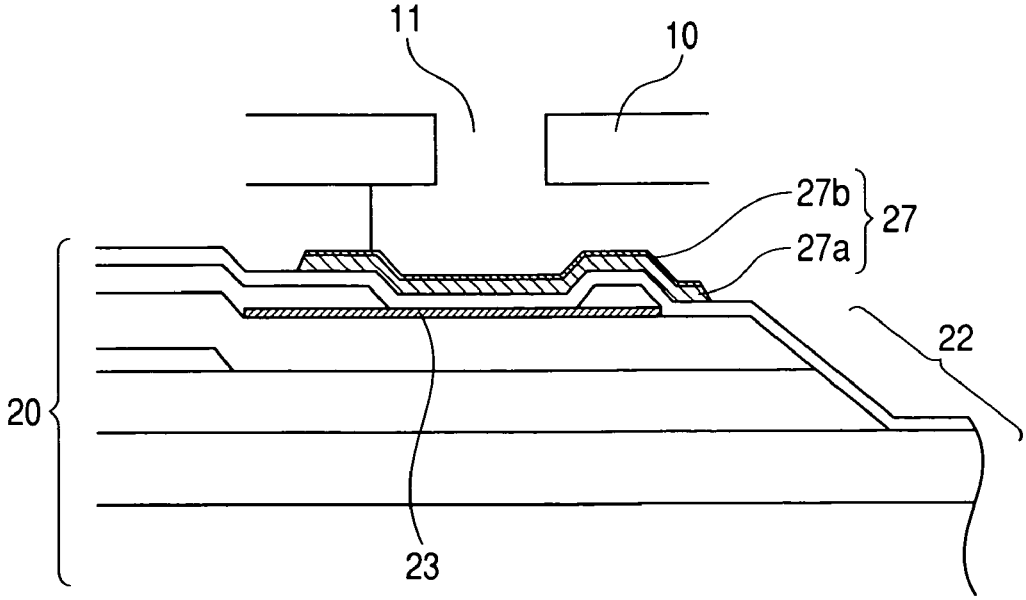
FIG. 10 is a sectional view showing another example of the ink jet head preferably used for the invention.

FIG. 10 is a sectional view showing another example of the ink jet head preferably used for the invention. In FIG. 10, the same constituent as FIG. 9 is represented by the same reference numeral as FIG. 9.

The ink jet head of the example 2 differs from the ink jet head of the example 1 in that the insulation film 26 has a single layer and the cavitation-resistant film 27 has the double-layer structure. Other configurations of the example 2 are similar to the example 1.

In the example 2, the insulation film 26 is made of SiC, and the thickness of the insulation film 26 is set to 0.35 μm. The cavitation-resistant film 27 has the structure in which a Ta film 27*a* and an Ir film 27*b* are laminated in the order from the insulation film 26 side. The thickness of the Ta film 27*a* is set to 0.2 μm, and the thickness of the Ir film 27*b* is set to 0.05 μm. Accordingly, the total thickness of the protection film on the heat generating resistance member 23 becomes 0.6 μm.

Thus, by forming the cavitation-resistant film 27 in the double-layer structure, not only the heat resistance can be decreased while the covering properties is maintained, but also the decrease in discharge characteristics caused by the thermal reaction of the ink or by the "kogation" which is generated by the carbonization of ink compositions can be prevented. Although the cavitation-resistant film 27 has the double-layer structure in the example 2, it is also possible that the cavitation-resistant film 27 has the structure in which at least three layers are laminated. Although a part of the cavitation-resistant film 27 is made of Ir in the example 2, instead of Ir, it is also possible to use a noble metal such as Pt or an alloy of the noble metal which has the film thickness not lower than 0.05 μm.

Assuming that the heat conductivity of the Ir thin film is 127 W/m·K, when the heat resistance value of the protection film is computed in the example 2, the heat resistance value of about $9.1\times10^{-2}$ $m^2\cdot K/W$ is obtained. Since the total heat resistance value of the heat accumulation layer 22 is equal to the example 1, the total heat resistance value of the heat accumulation layer 22 becomes about 199 times of the total heat resistance value of the protection film in the example 2.

CONFIGURATION EXAMPLE 3 OF INKJET HEAD

Figure 11:
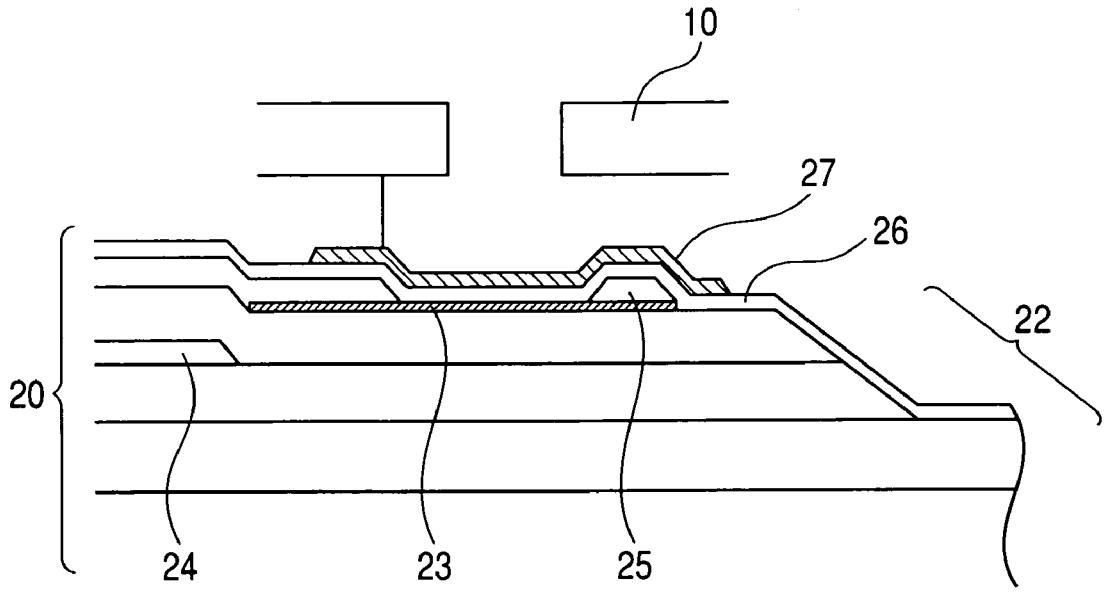
FIG. 11 is a sectional view showing still another example of the ink jet head preferably used for the invention.

FIG. 11 is a sectional view showing still another example of the ink jet head preferably used for the invention. In FIG. 11, the same constituent as FIG. 9 is represented by the same reference numeral as FIG. 9.

The ink jet head of the example 3 differs from the ink jet heads of the example 1 and the example 2 in that the insulation film 26 and the cavitation-resistant film 27 have the single layer structure respectively. Specifically, the insulation film 26 is formed by the SiC film whose thickness is 0.35 μm, and the cavitation-resistant film 27 is formed by the Ta film whose thickness is 0.2 μm. Accordingly, the total thickness of the protection film on the heat generating resistance member 23 becomes 0.55 μm.

When the heat resistance of the protection film is computed in the example 3, the heat resistance value of about $8.7\times10^{-9}$ $m^2\cdot K/W$ is obtained. The heat resistance of the example 3 has the smallest value in the configuration examples 1 to 3 of the ink jet head. That is, the bubbling efficiency of the example 3 is optimized in the configuration examples 1 to 3 of the ink jet head. In consideration of the covering reliability of the insulation film 26 at the steps of the electrode wirings 24 and 25 or thermal reaction-resistant characteristics and kogation-adhesion-resistant characteristics of the cavitation-resistant film 27, when the ink jet head obtains the sufficient performance, the bubbling efficiency is further improved by setting the smaller heat resistance value in the range from $5\times10^{-9}$ $m^2\cdot K/W$ to $50\times10^{-9}$ $m^2\cdot K/W$. The total heat resistance value of the heat accumulation layer 22 becomes about 208 times of the total heat resistance value of the protection film in the example 3.

Figure 12:
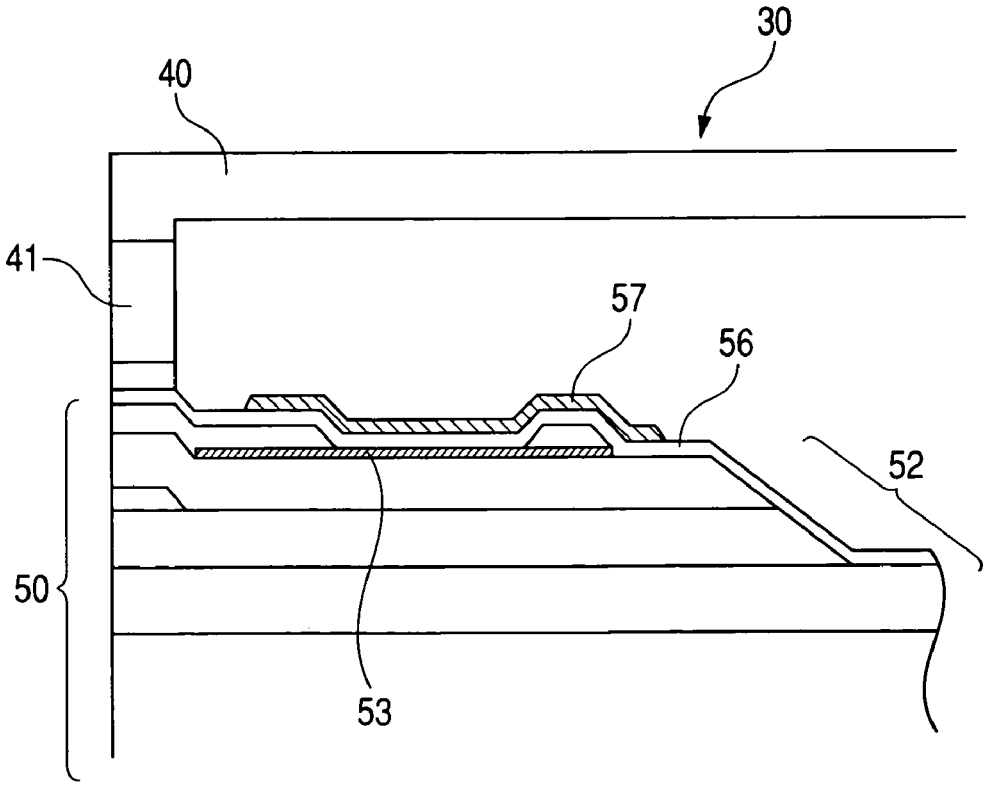
FIG. 12 is a sectional view showing an example of an edge-shooter type of ink jet head to which the invention is applied.

Thus, with respect to the ink jet head which is applied to the invention, preferred embodiments are described. Although the so-called side shoot type of ink jet head in which the discharge port 11 is formed at the opposite position to the heat generating resistance member 23 is described in the above-described examples 1 to 3, the invention is not limited to the side shoot type of ink jet head. As shown in FIG. 12, the invention can also be applied to the so-called edge shoot type of ink jet head 30.

As in the case of the side shoot type of ink jet head, the edge shoot type of ink jet head 30 has a base body 50 and a nozzle material 40 which is bonded to the base body 50. However, the edge shoot type of ink jet head differs from the side shoot type of ink jet head in the structure of the nozzle material 40. Specifically, a discharge port 41 is not located at the opposite position to the heat generating resistance member 53, but the discharge port 41 is formed in an end face of the nozzle material 40, and the ink is discharged toward the direction substantially parallel to an upper surface of the base body 50.

Even in the edge shoot type of ink jet head 30, the same effect as the side shoot type of ink jet head can be obtained by applying the configuration of the invention to the configurations of a heat accumulation layer 52 and the protection film including an insulation film 56 and a cavitation-resistant film 57.

As described above, when the ink jet head is driven with the drive pulse having widths of 0.2 μs to 2.0 μs, the total thickness of the protection film formed on the heat generating resistance member is set to the range from about 0.2 to about 0.6 μm, the total heat resistance value of the protection film is set to the range from $5\times10^{-9}$ $m^2\cdot K/W$ to $50\times10^{-9}$ $m^2\cdot K/W$, and the heat resistance value of the heat accumulation layer below the heat generating resistance member is set to at least double the heat resistance value of the protection film. Therefore, the heat transfer efficiency to the ink can be optimized without decreasing the insulation reliability of the protection film and without decreasing the performance of the cavitation resistance. Since any film structure can be adopted when the heat resistance value is in the above-described range, various materials can be used as long as the covering reliability of the heat generating resistance member is maintained, and a degree of freedom can be increased in design. The film structure which further improves the covering reliability can also be formed, and the invention also has a cost-reduction effect. With reference to the cavitation resistance, the film structure can freely be designed so that the heat resistance is in the above-described range. Therefore, the film structure in which the thermal reaction-resistant characteristics and the kogation-adhesion-resistant characteristics are further improved can be formed, so that not only the degree of freedom of the design is increased, but also the durability is improved.

This application claims priority from Japanese Patent Application No. 2003-434519 filed Dec. 26, 2003, which is hereby incorporated by reference herein.

What is claimed is:

1. An ink jet head base body in which a heat accumulation layer, a heater generating heat energy used for discharging ink, and a protection film protecting the heater are sequentially formed on a substrate, the ink jet head base body in which a total thickness of a portion above from the heater in the protection film ranges from 0.2 μm to 0.6 μm, a heat resistance value of the portion above from the heater in the protection film ranges from $5\times10^{-9}$ $m^2\cdot K/W$ to $50\times10^{-9}$ $m^2\cdot K/W$, and the heat resistance value of a portion below from the heater in the heat accumulation layer is not lower than double the heat resistance value of the portion above from the heater in the protection film.

2. An ink jet head base body according to claim 1, wherein a total heat resistance value of the protection film ranges from $5\times10^{-9}$ $m^2\cdot K/W$ to $10\times10^{-9}$ $m^2\cdot K/W$.

3. An ink jet head base body according to claim 1, wherein the protection film is formed by a plurality of thin films.

4. An ink jet head base body according to claim 1, wherein the protection film includes an SiC film whose film thickness is not lower than 0.2 μm.

5. An ink jet head base body according to claim 1, wherein the protection film includes an SiN film whose film thickness is not lower than 0.05 μm.

6. An ink jet head base body according to claim 1, wherein the protection film includes a Ta film whose film thickness is not lower than 0.2 μm.

7. An ink jet head base body according to claim 6, wherein the protection film has an insulation film, in which the film thickness ranges from 0.1 μm to 0.4 μm and heat conductivity ranges from 10 W/m·K to 200 W/m·K, and a cavitation-resistant film which is formed on the insulation film and includes the Ta film.

8. An ink jet head base body according to claim 7, wherein the insulation film includes the SiC film whose film thickness is not lower than 0.2 μm.

9. An ink jet head base body according to claim 8, wherein the insulation film further includes the SiN film.

10. An ink jet head base body according to claim 7, wherein the cavitation-resistant film further includes the thin film made of noble metal or an alloy of the noble metal.

11. An ink jet head base body according to claim 1, wherein the protection film includes the thin film made of the noble metal or the alloy of the noble metal whose film thickness is not lower than 0.05 μm.

12. An ink jet head base body according to claim 1, wherein the heat accumulation layer is formed by at least one thin film made of $SiO_2$, and the total thickness of the heat accumulation layer is not lower than 0.7 μm.

13. An ink jet head base body according to claim 1, wherein the heat accumulation layer is formed by the plurality of thin films, and at least one of the plurality of thin film layers is made of an $SiO_x$ film or a BPSG film.

14. An ink jet head base body according to claim 1, wherein an electrode wiring for energizing the heater is made of Al or the alloy of Al, and the thickness of the electrode wiring ranges from 0.1 μm to 1.0 μm.

15. An ink jet head which has an ink jet head base body in which a heat accumulation layer, a heater generating heat energy used for discharging ink, and a protection film protecting the heater are sequentially formed on a substrate, a discharge port for discharging ink being provided corresponding to the heater in the ink jet head, the ink jet head in which a total thickness of a portion above from the heater in the protection film ranges from 0.2 μm to 0.6 μm, a heat resistance value of the portion above from the heater in the protection film ranges from $5\times10^{-9}$ $m^2\cdot K/W$ to $50\times10^{-9}$ $m^2\cdot K/W$, and the heat resistance value of a portion below from the heater in the heat accumulation layer is not lower than double the heat resistance value of the portion above from the heater in the protection film.

16. A method for driving an ink jet head comprising:

using an ink jet head which has an ink jet head base body in which a heat accumulation layer, a heater generating heat energy used for discharging ink, and a protection film protecting the heater are sequentially formed on a substrate, a discharge port for discharging ink being-provided corresponding to the heater in the ink jet head, the ink jet head in which a total thickness of a portion above from the heater in the protection film ranges from 0.2 μm to 0.6 μm, a heat resistance value of the portion above from the heater in the protection film ranges from $5\times10^{-9}$ $m^2\cdot K/W$ to $50\times10^{-9}$ $m^2\cdot K/W$, and the heat resistance value of a portion below from the heater in the heat accumulation layer is not lower than double the heat resistance value of the portion above from the heater in the protection film; and driving the heater for drive energization time ranging from 0.2 μs to 2 μs to discharge the ink from the discharge port.

17. An ink jet recording apparatus comprising:

an ink jet head which has an ink jet head base body in which a heat accumulation layer, a heater generating heat energy used for discharging ink, and a protection film protecting the heater are sequentially formed on a substrate, a discharge port for discharging ink being provided corresponding to the heater in the ink jet head, the ink jet head in which a total thickness of a portion above from the heater in the protection film ranges from 0.2 μm to 0.6 μm, a heat resistance value of the portion above from the heater in the protection film ranges from $5\times10^{-9}$ $m^2\cdot K/W$ to $50\times10^{-9}$ $m^2\cdot K/W$, and the heat resistance value of a portion below from the heater in the heat accumulation layer is not lower than double the heat resistance value of the portion above from the heater in the protection film; and driving means for driving the heater for drive energization time ranging from 0.2 μs to 2 μs.

* * * * *